US010118142B2

(12) United States Patent
Vidakovic et al.

(10) Patent No.: US 10,118,142 B2
(45) Date of Patent: Nov. 6, 2018

(54) HOMOGENIZER PROCESSING PLATE FOR SELF-SECURING OF SAMPLE TUBES

(71) Applicant: OMNI INTERNATIONAL, INC., Kennesaw, GA (US)

(72) Inventors: Voya Vidakovic, Marietta, GA (US); Thomas Gray, Canton, GA (US); John Hancock, Atlanta, GA (US); Spencer Smith, Marietta, GA (US); Alan Vaughn, Dallas, GA (US)

(73) Assignee: Omni International, Inc., Kennesaw, GA (US)

( * ) Notice: Subject to any disclaimer, the term of this patent is extended or adjusted under 35 U.S.C. 154(b) by 290 days.

(21) Appl. No.: 14/993,912

(22) Filed: Jan. 12, 2016

(65) Prior Publication Data

US 2016/0199800 A1 Jul. 14, 2016

Related U.S. Application Data

(60) Provisional application No. 62/102,300, filed on Jan. 12, 2015.

(51) Int. Cl.
*B01F 9/00* (2006.01)
*B01L 9/06* (2006.01)

(52) U.S. Cl.
CPC ..... *B01F 9/003* (2013.01); *B01F 9/0005* (2013.01); *B01L 9/06* (2013.01); *B01L 2200/023* (2013.01); *B01L 2200/025* (2013.01); *B01L 2300/0609* (2013.01); *B01L 2300/0832* (2013.01); *B01L 2400/0409* (2013.01)

(58) Field of Classification Search
USPC ..... 366/214, 245
See application file for complete search history.

(56) References Cited

U.S. PATENT DOCUMENTS 4,439,177 A * 3/1984 Conway ..... B04B 5/0428 220/23.87
4,981,585 A 1/1991 Kelley et al.
5,549,540 A * 8/1996 Moore ..... B04B 5/0428 248/100
5,567,050 A 10/1996 Zlobinsky et al.
7,101,077 B2 9/2006 Esteve et al.
2014/0293735 A1* 10/2014 Vidakovic ..... B01F 15/00733 366/245

* cited by examiner

*Primary Examiner* — Mark Halpern
(74) *Attorney, Agent, or Firm* — Gardner Groff Greenwald & Villanueva, PC

(57) ABSTRACT

A processing plate assembly for mounting to a homogenizer and for holding tubes containing samples to be homogenized. The processing plate assembly includes a mounting structure and one or plural tube holders. The mounting structure removably or permanently mounts to the homogenizer and can be provided by for example a flat plate-like mounting structure. The tube holders are attached to the mounting structure and hold the tubes in generally tangential use positions with a centroid of each tube positioned along a longitudinal axis of the tube and axially offset from a radius line of the processing plate that is perpendicular to the tube axis. In this way, the homogenizer imparts sinusoidal swashing forces on the tubes that urge the tubes forward into securement in their tube holders and that produces improved homogenization in the tubes.

20 Claims, 14 Drawing Sheets

HOMOGENIZER PROCESSING PLATE FOR SELF-SECURING OF SAMPLE TUBES

CROSS-REFERENCE TO RELATED APPLICATION

This application claims the priority benefit of U.S. Provisional Patent Application Ser. No. 62/102,300, filed Jan. 12, 2015, which is hereby incorporated herein by reference.

TECHNICAL FIELD

The present invention relates generally to laboratory devices and accessories for homogenizing sample materials, and particularly to accessories for mounting sample tubes to the homogenizing devices to homogenize the samples in the tubes.

BACKGROUND

Laboratory equipment such as some designs of homogenizers include a hub to which a processing plate is removably mounted, with the hub inducing a vigorous "swashing" motion of the processing plate, and with the processing plate holding tubes containing samples to be homogenized. This swashing motion of the processing plate is not rotational about the center of the processing plate, but instead is angularly reciprocating to induce a force with a rotational (sinusoidal) component and an axial component. Such homogenizer devices are commercially available for example under the brand name BEAD RUPTOR from Omni International, Inc. (Kennesaw, Ga.), and such processing plates are commonly referred to as "swash plates."

Homogenization involves disaggregating, mixing, re-suspension, or emulsifying the components of a sample using a high-shear process with significant micron-level particle-size reduction of the sample components. Homogenization is commonly used for a number of laboratory applications such as creating emulsions, reducing agglomerate particles to increase reaction area, cell destruction for capture of DNA material (proteins, nucleic acids, and related small molecules), DNA and RNA amplification, and similar activities in which the sample is bodily tissue and/or fluid, or another substance.

Because of the very large forces required to be generated for homogenization, the processing plate must be swashed at very high oscillatory rates. Because of this, the tubes can sometimes loosen relative to the processing plate, which can result in the swashing forces not all being transmitted to the samples, which in turn can result in a lessened homogenization effect and/or in tube failure, tube ejection, or a combination thereof.

Accordingly, it can be seen that there exists a need for a better way to achieve very large swashing forces by homogenizers without causing the sample tubes to loosen. It is to the provision of solutions to this and other problems that the present invention is primarily directed.

SUMMARY

Generally described, the present invention relates to a processing plate assembly for mounting to a homogenizer and for holding tubes containing samples to be homogenized. The processing plate assembly includes a mounting structure and one or plural tube holders. The mounting structure removably or permanently mounts to the homogenizer and can be provided by for example a flat plate-like mounting structure. The tube holders are attached to the mounting structure and hold the tubes in generally tangential use positions with a centroid of each tube positioned along a longitudinal axis of the tube and axially offset from a radius line of the processing plate that is perpendicular to the tube axis. In this way, the homogenizer imparts sinusoidal swashing forces on the tubes that urge the tubes forward into securement in their tube holders and that produces improved homogenization in the tubes.

The specific techniques and structures employed to improve over the drawbacks of the prior devices and accomplish the advantages described herein will become apparent from the following detailed description of example embodiments and the appended drawings and claims.

DESCRIPTION OF EXAMPLE EMBODIMENTS

Figure 1:
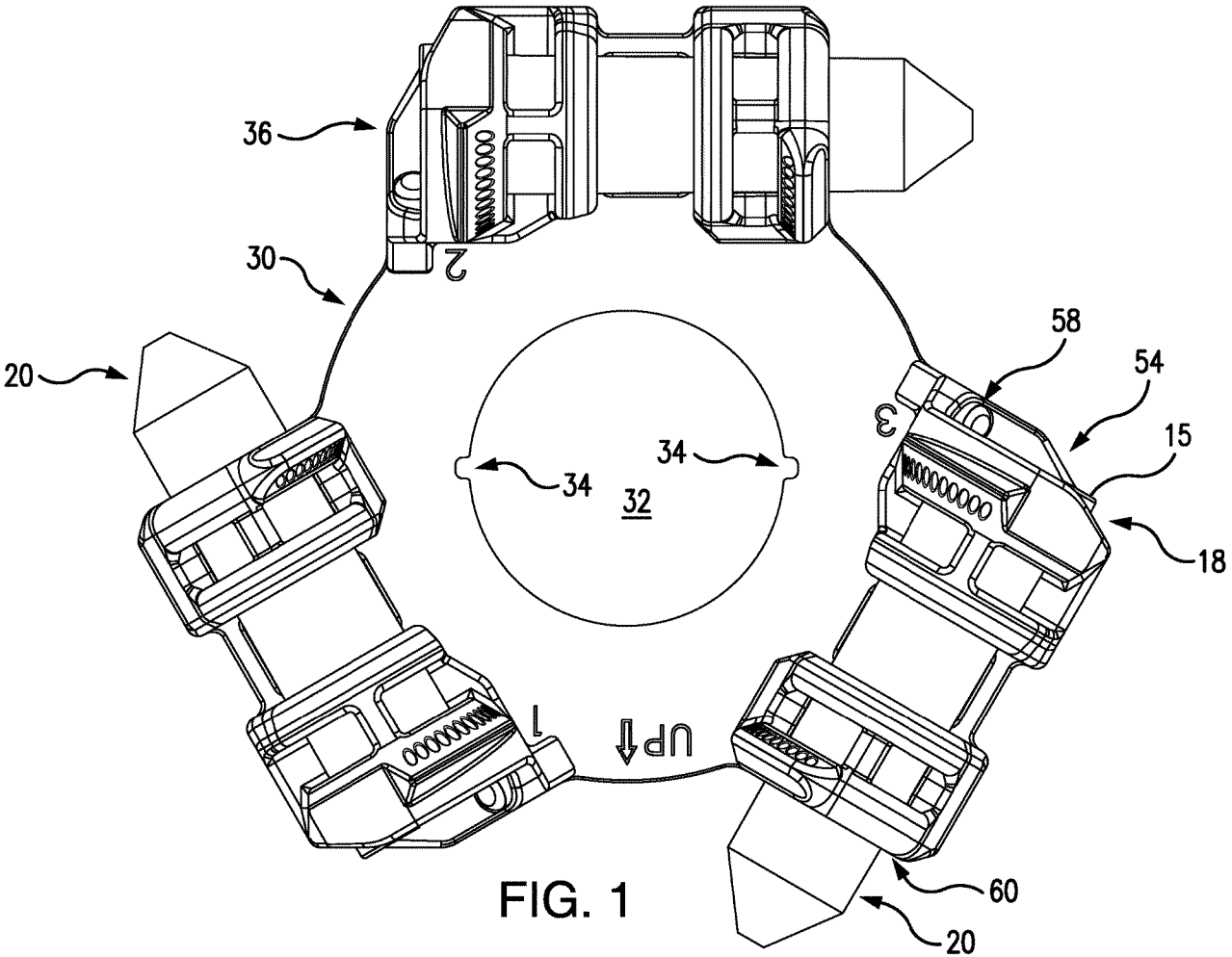
FIG. 1 is a plan view of a processing plate with tube holders according to an example embodiment of the present invention, shown in use holding sample tubes.

The present invention relates to processing plate assemblies that mount to a homogenizer and that hold tubes containing samples to be processed. The processing plate assemblies include tube holders that receive and position sample tubes so that the swashing forces on the sample tubes induce the sample tubes to stay in place in the tube holders and thus against withdrawal from the tube holders. In this way, the sample tubes are urged into securement in the tube holders without the need for a conventional locking latch, clamp, or other mechanical locking structure. This results in a more-foolproof tube securement, as well as no moving lock parts that could vibrate and come loose.

A few preliminary definitions are as follows. "Homogenizer" as used herein is intended to be broadly construed to include any type of rotary device that processes samples, including not just the high-powered shaker-mill homogenizer device described herein but also other laboratory equipment such as centrifuges, vortexers, shakers, and agitators. "Processing" as used herein is intended to be broadly construed to include not just swashing motions/forces but any particle-size reduction of samples by agitation forces, and "tube" is intended to be broadly construed to include any container that can hold a sample during homogenization and is not necessarily limited to clear, plastic, cylindrical vials. Also, "sample" as used herein is intended to be broadly construed to include any type of substance that can be homogenized and for which homogenization could be useful, such as but not limited to human or non-human bodily fluid and/or tissue (e.g., blood, bone-marrow cells, a coronary artery segment, or pieces of organs), other organic matter (e.g., plants or food), and/or other chemicals.

Referring now to the drawings, FIGS. 1-18 show a processing plate assembly 30 according to an example embodiment of the present invention. The processing plate 30 removably mounts to a hub 9 of a homogenizer 10 and holds tubes 20 containing samples to be homogenized (see, e.g., FIG. 11). The processing plate 30 can be made of conventional materials such as plastic and/or metal using conventional fabrication techniques such as molding or machining.

The processing plate assembly 30 of this embodiment includes a generally disc-shaped, annular, and plate-like flat mounting structure 31, with a central axial mounting opening 32 extending axially/vertically therethrough and adapted to engage the homogenizer 10, and with at least one anti-rotation key element 34 such as the depicted two female elements (e.g., slots, grooves, or other recessed portions) formed in the inner wall defining the mounting opening. The anti-rotation key elements 34 engage mating elements (described below) of the homogenizer 10 to prevent the processing plate 30 from rotating about its center/axis. As such, the depicted plate-like mounting structure 31 is of a conventional type. In other embodiments, the processing-plate mounting structure is in other forms such as not disc-shaped (e.g., square or polygonal), not annular (e.g., for bottom-surface hub mounting), and/or not plate-like (e.g., thicker and/or not flat). As such, the term "plate" as used herein is not intended to be limited to disc-shaped annular plate-like elements but rather is intended to be broadly construed to include other mounting elements such as arms (e.g., radial), frames, cartridges, and/or other annular or non-annular structures that can mount to a homogenizer and hold tubes of samples during homogenizing. And the anti-rotation key elements can be provided in other forms, such as a vice-versa arrangement (male elements on the processing plate), a non-symmetrical mounting opening and hub profile/shape, and other conventional mating structures of the processing plate and hub to prevent rotational movement between them.

The homogenizer 10 includes a hub 9 that receives and extends through the plate mounting opening 32 about the plate axis. Typically, the hub 9 includes a fastening structure such as screw threads (e.g., external screw threads) and at least one anti-rotation key element such as two male elements (e.g., tabs, tongues, pins, bosses, or ridges). The male key elements are received into the female key elements 34 of the processing plate 30 to restrain the plate from rotation about its center/axis (or they can be provided by other structures, as described above). The hub 9 can include a base portion upon which the processing plate 30 is supported, a middle portion including the hub key elements, and an upper portion including the screw threads, with the upper portion having a smaller diameter (so the processing plate 30 can be slid down over it) and the lower portion having a larger diameter (to support the plate) than the middle portion (see, e.g., FIG. 11). In other embodiments, the homogenizer includes a bore that receives a hub of the processing plate in a vice-versa arrangement.

The homogenizer 10 also includes a lock assembly 8 that releasably locks to the hub 9 to secure the processing plate 30 in place for homogenizing use. The lock assembly 8 includes a cap 7 with a fastening structure such as screw threads (e.g., internal screw threads) that mate with the screw threads of the homogenizer hub 9 (see, e.g., FIG. 11). When the lock assembly 8 is slid onto the hub 9, the mounting structure 31 of the processing plate 30 is sandwiched between the hub base and the lock cap 7 to secure the plate in place. In other embodiments, instead of being removable, the processing plate is permanently attached to the homogenizer.

The homogenizer 10 that the processing plate assembly 30 is used with can be of a conventional type well-known in the art such as a bead-mill homogenizer commercially available under the BEAD RUPTOR brand from Omni International, Inc. (Kennesaw, Ga.). Or the homogenizer 10 can be of a conventional type such as any of those disclosed by U.S. Pat. Nos. 5,567,050 and 7,101,077, which are incorporated herein by reference. The processing plate 30 can mount to the homogenizer 10 by the herein-described or other conventional attachments that are well-known in the art, and the swash forces can be generated by the homogenizer and transferred to the plate (to impart the swashing motion to the plate, in turn to the tubes 20, and in turn to the samples) by conventional agitation structures (e.g., an eccentric cam-like collar) that are well-known in the art. Accordingly, more-exacting details of the homogenizer 10 are not provided herein for brevity.

The sample tubes 20 each include a container body 19 and a cap 18 that releasably attaches to the container by cooperating fastening structures. Typically, the fastening structures are screw threads, for example external screw threads on the tube container 19 and internal screw threads on the tube cap 18. In the depicted embodiment, the tube containers 19 are generally cylindrical and elongated and the tube caps 18 are generally cylindrical and not elongated (e.g., they're puck-shaped), with the caps having a greater diameter than the containers (see, e.g., FIG. 5). As such, the tube caps 18 each have a peripheral annular bottom surface 17 extending radially outward beyond the tube containers 19.

Referring particularly to FIGS. 1-5, the innovative processing plate assembly 30 includes at least one and typically a plurality of holders 36 for the sample tubes 20. For example, the depicted processing plate 30 includes three of the tube holders 36 for holding three of the tubes 20, while other embodiments can include more or fewer tube holders. The tube holders 36 hold the tubes 20 securely in place in a use position for vigorous swashing agitation to homogenize the samples in the tubes 20. The tube holders 36 can be integrally formed with the plate-like mounting structure 31 as one piece, they can be formed separately and permanently attached together by conventional fastening elements and techniques, or they can be separate parts that detachably couple together by conventional fastening elements and techniques (so the tube holders can be removed as desired).

The tube holders 36 hold the sample tubes 20 in the use position laying on their sides 16, if not precisely horizontal then closer to horizontal than vertical (in the horizontal plate orientation shown). In the depicted embodiment, for example, the tube holders 36 hold the tubes 20 in the use position laying on their sides 16 in a substantially horizontal position, with a longitudinal axis 38 of each of the tube holders (and thus of each of the tubes) being substantially horizontal and substantially parallel to the substantially flat processing-plate mounting structure 31 (see FIGS. 3-4). In other embodiments, the tube holders hold the tubes in the use position laying on their sides at an angle of less than about 45 degrees from horizontal. In embodiments in which the processing plate 30 is not mounted to the homogenizer 10 in a horizontal orientation, it will be understood that reference to horizontal for the tube orientation means perpendicular to the center/axis of the processing plate (typically parallel to the plate, if flat).

In addition, the tube holders 36 hold the sample tubes 20 in the use position laying on their sides 16, if not precisely tangential then closer to tangential than radial (relative to the center/axis of the processing plate 30). In the depicted embodiment, for example, the tube holders 36 hold the tubes 20 in the use position laying on their sides 16 in a substantially tangential position, with the longitudinal axis 38 of each of the tube holders (and respective tubes) at an angle $\alpha$ of about 90 degrees relative to a radius line 40 from the center/axis of the processing plate 30 (see FIG. 5). As such, the tube-holder axes 38 of the depicted embodiment are tangential to the processing plate 30. In other embodiments, the tube holders hold the tubes in the use position laying on their sides with the tube-axis-to-plate-radius angle $\alpha$ being between about 45 degrees and about 90 degrees or between about 90 degrees and about 135 degrees and are thus not precisely tangential but still closer to tangential than radial (i.e., generally tangential).

Furthermore, the tube holders 36 hold the sample tubes 20 in the side-laid use position with the center of mass (the centroid) 14 of each tube 20 forward (relative to the angular/rotational agitation direction 42) of the respective perpendicular radius line 40 of the processing plate 30. (The centroid 14 of the tube 20 is the same regardless of whether the tube is empty or contains a sample, and regardless of the sample mass and/or volume, because of the uniform sinusoidal swashing motion, that is, the centroid of the tube alone is the same as the centroid of the combined tube and sample.) The centroid 14 is thus forward of the intersection point 12 of the tube-holder axis 38 and the perpendicular radius line 40 (see FIG. 5). In other embodiments, the tube holders hold the sample tubes in the side-laid use position with the centroid of each tube rearward of the intersection point of the tube-holder axis and the perpendicular radius line. As such, the tube holders 36 hold the sample tubes 20 with their centroids 14 axially offset (forward or rearward) from the perpendicular radius lines 40. The relative axial length of the offset as depicted is representative for illustration purposes, and in other embodiments it can be greater (e.g., to hold the tube centroid farther forward) or lesser.

Moreover, the tube holders 36 receive the sample tubes 20 axially forwardly from the rear (relative to the angular/rotational agitation direction 42). That is, the tubes 20 move into holding engagement by the tube holders 36 by sliding the forward ends of the tubes in a forward direction into the rear ends of the tube holders. With the tube centroid 14 forward of the radius line 40, the swashing forces on the sample tubes 20 induce the sample tubes forward in the tube holders 10 and against rearward withdrawal from the tube holders.

Accordingly, with the tube holders 36 holding the sample tubes 20 in the use position laying on their sides 16 with their centroids 14 positioned forward of the radius line 40, the tubes are urged into securement in the tube holders 36 without the need for a locking latch with moving parts that can come loose. In fact, because of the very high operating speeds and very large forward forces, the processing plate 30 can be mounted to a homogenizer 10 in a neutral/non-use position that is not horizontal for example that is in a vertical plane.

And with the tube holders 36 holding the sample tubes 20 in the use position laying on their sides 16 in a substantially horizontal and substantially tangential position and with their centroids 14 forward of the radius line 40, the resulting swashing motion profile (see FIGS. 6-18) causes grinding materials (e.g., beads) inside the sample tubes to spin around the inside of the tubes while being forced into the bottom (e.g., forward) ends 15 of the tubes (opposite the top-end caps 18). This produces an improved grinding effect on the samples in the tubes 20 for more-effective processing. This also allows the overall system (the homogenizer 10, the sample tubes 20, and the processing plate 30) to run quieter and cooler.

Figure 2:
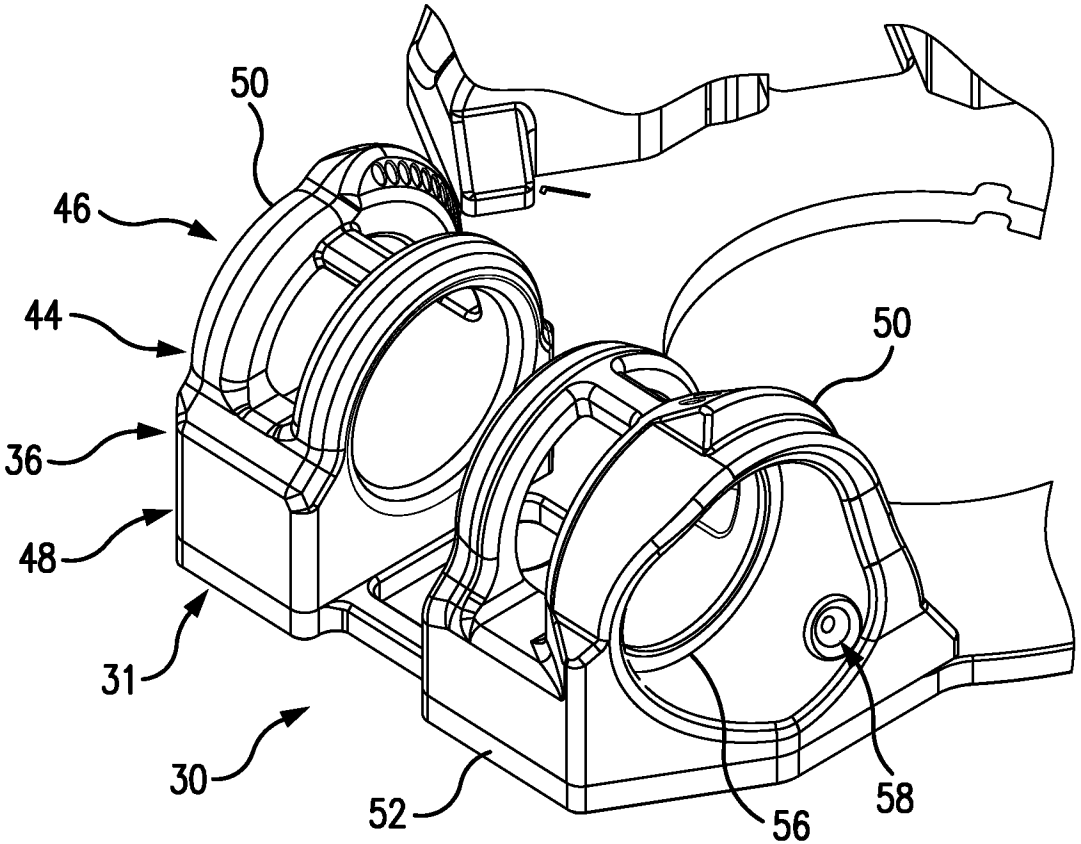
FIG. 2 is a perspective view of of a portion of the processing plate of FIG. 1, showing details of one of the tube holders without a sample tube.
Figure 3:
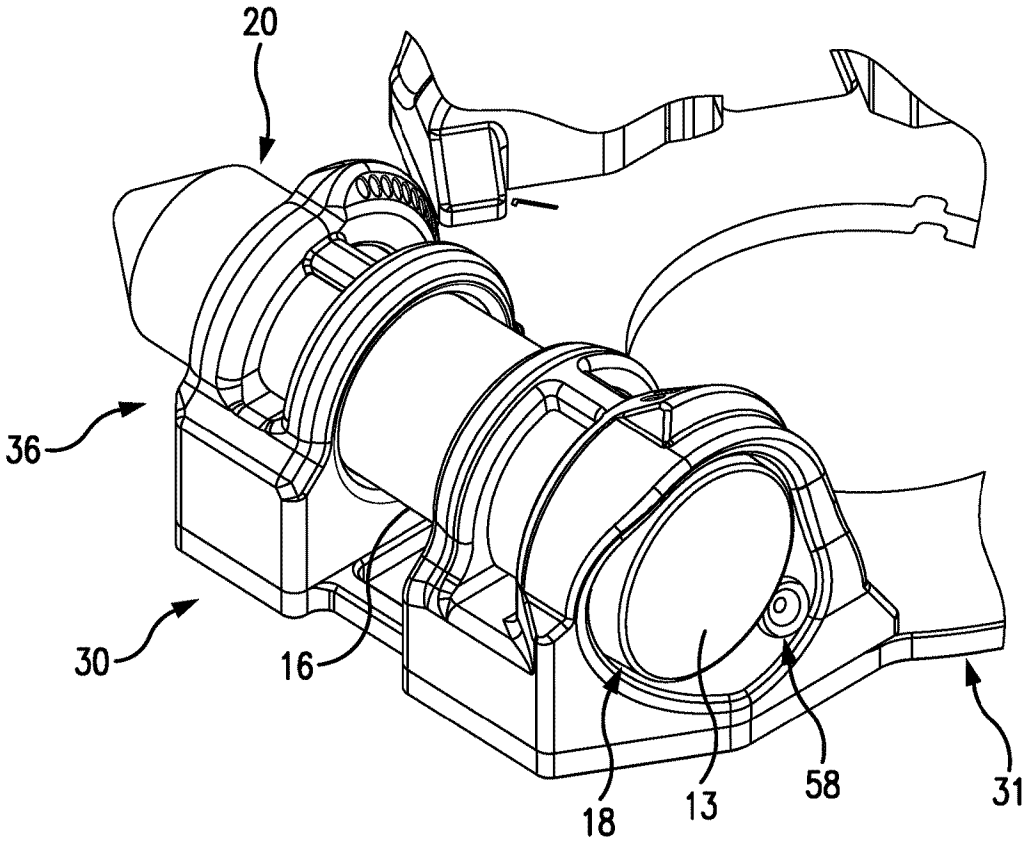
FIG. 3 shows the processing plate portion of FIG. 2 with a sample tube mounted to the tube holder.
Figure 4:
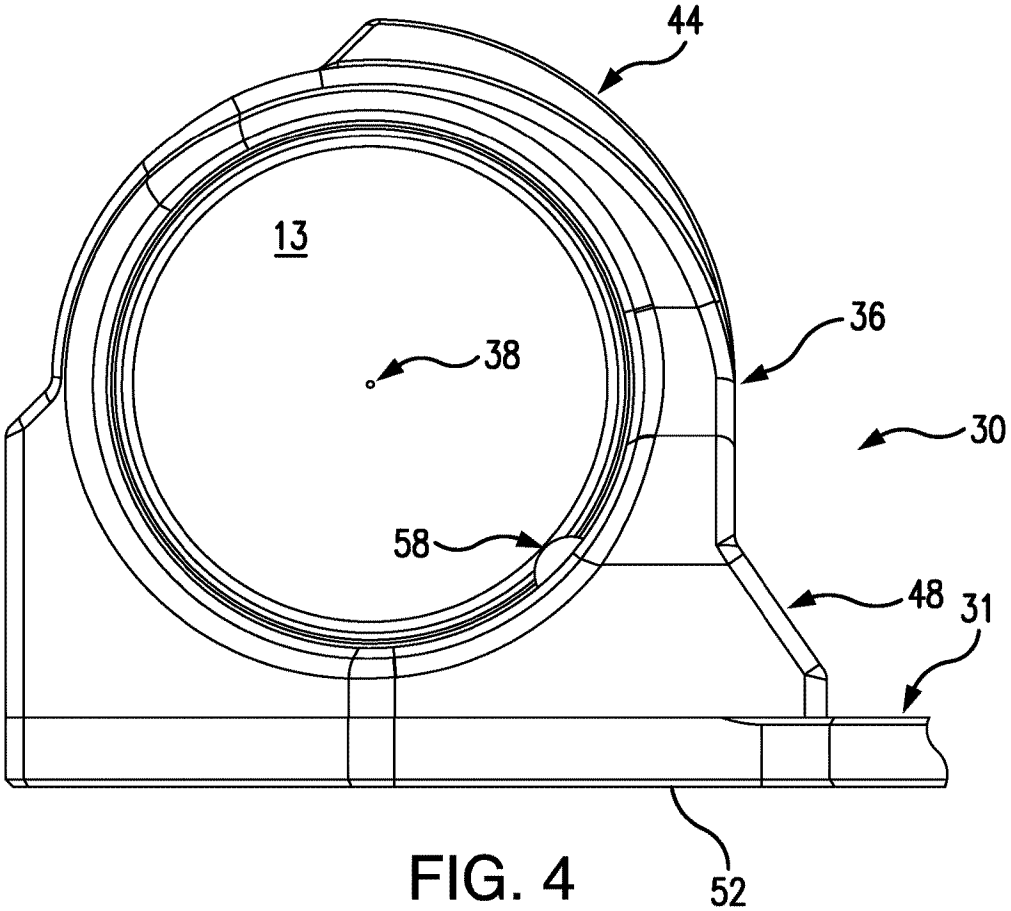
FIG. 4 is an end view of the processing-plate tube holder and the sample tube of FIG. 3.
Figure 5:
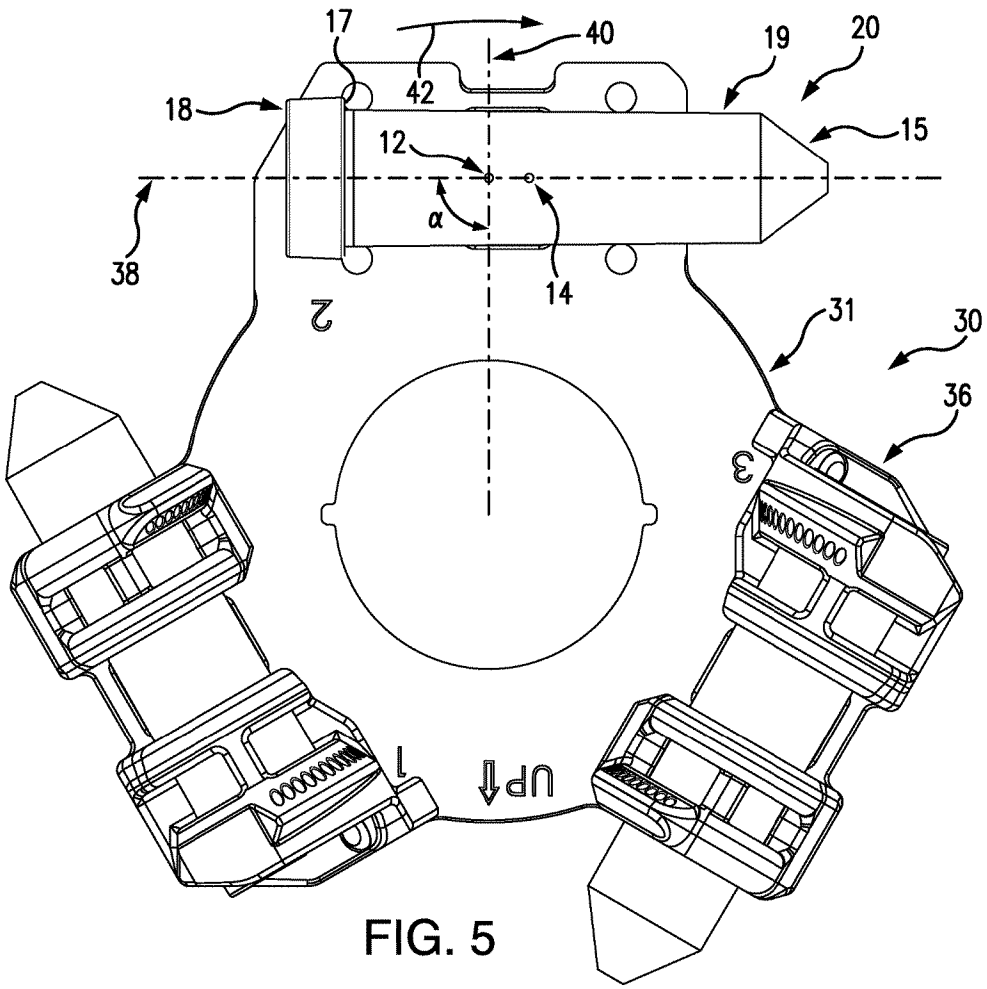
FIG. 5 shows the processing plate of FIG. 1 with one of the tube holders not shown in order to better-show the relationship between the sample tube and the processing plate.

To hold the sample tubes 20 in this use position, the tube holders 36 include a housing 44 with a bore 46 sized and shaped to receive and hold the tubes and with a base 48 adapted to mount to the processing-plate mounting structure 31 (see FIG. 2). For example, for use with cylindrical sample tubes 20 having containers 19 with an about 3.0 cm outer diameter, the housing bore 46 has an about 3.0 cm inner diameter, with the housing bore inner diameter slightly greater than the tube container outer diameter for longitudinally/axially sliding the tube into the bore easily but with substantially no (negligible) excess transverse/radial play. The housing 44 can be provided in any of a variety of different forms, including one or more circumferential bands, for example the four circumferential bands 50 of the depicted embodiment. And the four circumferential bands 50 can be provided in a two-piece tube holder 36, with a rear section having one or more axial-movement tube retainers and a forward section having no axial-movement tube retainer, as described below. In other embodiments, the housing can be in the form of clips (e.g., C-shaped and thus not circumferential but nevertheless not permitting lateral insertion and removal of the tubes), sleeves (e.g., tubular sheets defining the bores), frames (e.g., bars collectively defining the bores), cassettes/cartridges (e.g., holding multiple tubes), and/or other structures that can hold the tubes in the use position described herein during processing.

As noted above, the tube holders 36 receive the sample tubes 20 axially from the rear in a forward direction (relative to the angular/rotational agitation direction 42). Thus, the housings 44 each define a rear access opening 54 through which the respective sample tube 20 is axially inserted (forwardly) and removed (rearwardly). Because of the forward position of the centroids 14 of the tubes 20, the swashing forces urge the tubes forward in the tube-holder housings 44 (as described above) so they cannot back themselves out of the tube holders 36.

In addition, the tube holders 36 each include at least one forward-motion mechanical stop 56 that contacts the sample tubes 20 in their use position and prevents their further forward axial motion relative to their tube holder (see FIG. 1). For example, the mechanical stops 56 can be provided by an inner flange in the bore 46 of the housing 44 that contacts the peripheral annular bottom surface 17 of the tube cap 18, or that contacts an outer flange (see, e.g., FIG. 6) of the tube 10 adjacent the tube cap 18, to prevent further forward motion of the tube 20. In other embodiments, the mechanical stops are provided by tabs, pins, or other types of structures that contact the tube cap or flange to prevent further forward movement of the tubes. In such embodiments, the mechanical stop 56 is positioned forward of the rear-end opening of the tube holder 36 and divides the housing bore 46 into a rearward cap-holding section and a forward body-holding section with a smaller diameter than the cap-holding section. And in some other embodiments, the mechanical stops contact other surfaces of the tubes (e.g., flanges, ribs, tabs, wings, or other extension structures) to prevent their further forward movement. Because of the forward position of the centroids 14 of the tubes 20, the swashing forces urge the tubes forward in the tube-holder housings 44 (as described above) against the mechanical stops 56 and thereby hold the tubes in the use position during homogenizing use.

To retain the sample tubes 20 from sliding out of the tube-holder bores 46 due to gravity when samples are not being homogenized (i.e., when there is no swashing motion to self-secure the tubes in place), the tube holders 36 can each include at least one retaining element 58 mounted for example on the respective housing 44. In the depicted embodiment, the retainer 58 is a plunger that is positioned adjacent the rear-end opening (larger cap-receiving diameter) of the housing 44, that is spring-biased radially inward into the bore 46 into a retaining position contacting the top surface 13 of the tube cap 18 to block rearward axial removal of the tube (see FIGS. 3-4), and that resiliently retracts radially outward into the housing clear of the cap to permit tube removal. The spring force and the size and shape of the spring-biased retainer 58 are selected for withstanding gravitational forces when the tube 20 contains a sample and regardless of the orientation of the processing plate 30, but not for withstanding the large oscillating swashing forces during homogenization. In this way, the tubes 20 can be easily slid into and out of the tube holders 36 by depressing the retainers 58 and sliding the tubes in or out. In addition, when the retainers 58 resiliently return to their extended retaining position they provide a tactile, audible indication that they are properly seated so the tube 20 won't slide backward out while the next tube is being loaded. The retainers 58 remain in contact with the tube cap 18 with some residual inward spring force to assist in the forward bias of the tube and cap assembly into the holder. This residual force also inhibits unwanted cap 18 loosening during processing. In other embodiments, the retainer 58 is provided by a pivotal latch, a slide latch, a screw plug, or another conventional retaining element that can be used to retain the tube in the tube holder under the above-described relatively ordinary gravitational forces.

The opposite, forward end of the tube holder 36 typically has no such mechanical stops or retaining elements. In the depicted embodiment, the forward end of the tube holder 36 defines a front-end opening (smaller diameter for receiving container but not cap) 60 through which the bottom end 15 of the tube 20 is inserted into the use position and can extend without restriction. As such, longer tubes 10 can be used with the same processing plate assembly 30, as there are no retaining elements at the tube-holder front ends and the tube centroids 14 will be positioned even farther forward relative to the perpendicular radius line 40 (based on the fixed rear-end mechanical stop 56). Accordingly, each processing plate assembly 30 has minimum length of the tube 20 that can be properly used with it, but not necessarily a maximum (though this can be limited by other factors such as interference with adjacent tubes and/or wind resistance). In other embodiments, the tube holders include forward mechanical stops and/or retaining elements for limiting the forward motion of the tubes relative to their housings. And in yet other embodiments, the tube holders include adjustable or repositionable mechanical stops for limiting the forward motion of the tubes relative to their housings for smaller or longer tubes to achieve a desired centroid-to-radius-line offset length for a given application.

FIGS. 6-18 show the swashing motion of the tubes 20 produced by the processing plate assembly 30. As described above, the processing plate assembly 30 does not rotate about its center axis, but instead swashes sinusoidally as the agitator of the homogenizer rotates in the agitator angular direction 42 (see also FIG. 5) around the hub 9 to sequentially engage and push up on locations (defining a circular line or band) of the processing plate 30, then disengage whereby those processing plate locations are caused to move back down, in a repeating fashion.

Figure 6:
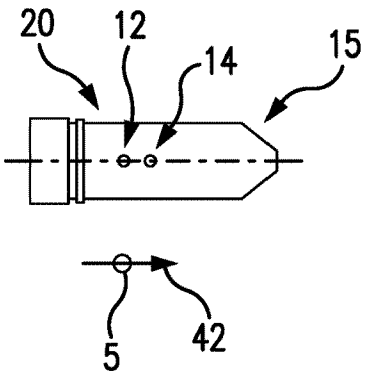
FIGS. 6-10 are schematic diagrams showing a sinusoidal swashing motion profile of a sample tube resulting from use of the processing plate.
Figure 7:
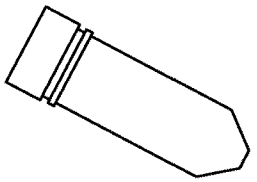
Figure 8:
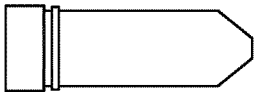
Figure 9:
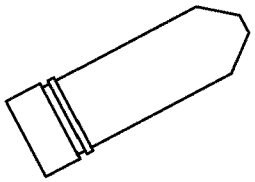
Figure 10:
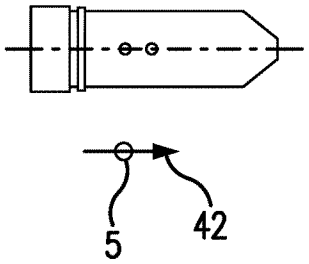

FIGS. 6-10 show schematically a 360-degree cycle of the sinusoidal swashing motion profile of one of the tubes 20 (tube position number 2 in FIGS. 11-18) produced by the processing plate assembly 30. These figures show the tube 20 moving through a cosine wave from engagement of the processing plate 30 by the agitator (schematically represented as element 5) rotating about the hub 9 in the agitator direction 42. In particular, FIG. 6 shows the tube 20 in the 0-degree position of the cosine wave with the processing plate 30 (at the location of the tube) engaged and pushed upward by the agitator 5. Similarly, FIG. 7 shows the tube 20 in the 90-degree position as the agitator is disengaging, FIG. 8 shows the 180-degree position with the agitator disengaged, FIG. 9 shows the 270-degree position as the agitator is re-engaging, and FIG. 10 shows the tube back in the 360-degree/0-degree position. As can be seen in these figures, the tube bottom end 15 is farther away (forwardly) from the tube centroid 14 than is the tube top end (rearwardly), so the amplitude of the sine wave is greater for the tube bottom than the tube top. This causes the grinding materials (e.g., beads) inside the sample tubes 20 to spin around the inside of the tubes while being forced into the tube bottom ends 15 for improved homogenization. And this causes the tube 20 to be urged forward in the tube holder 36 under great force so that it cannot back itself out of the tube holder during homogenizing use.

Figure 11:
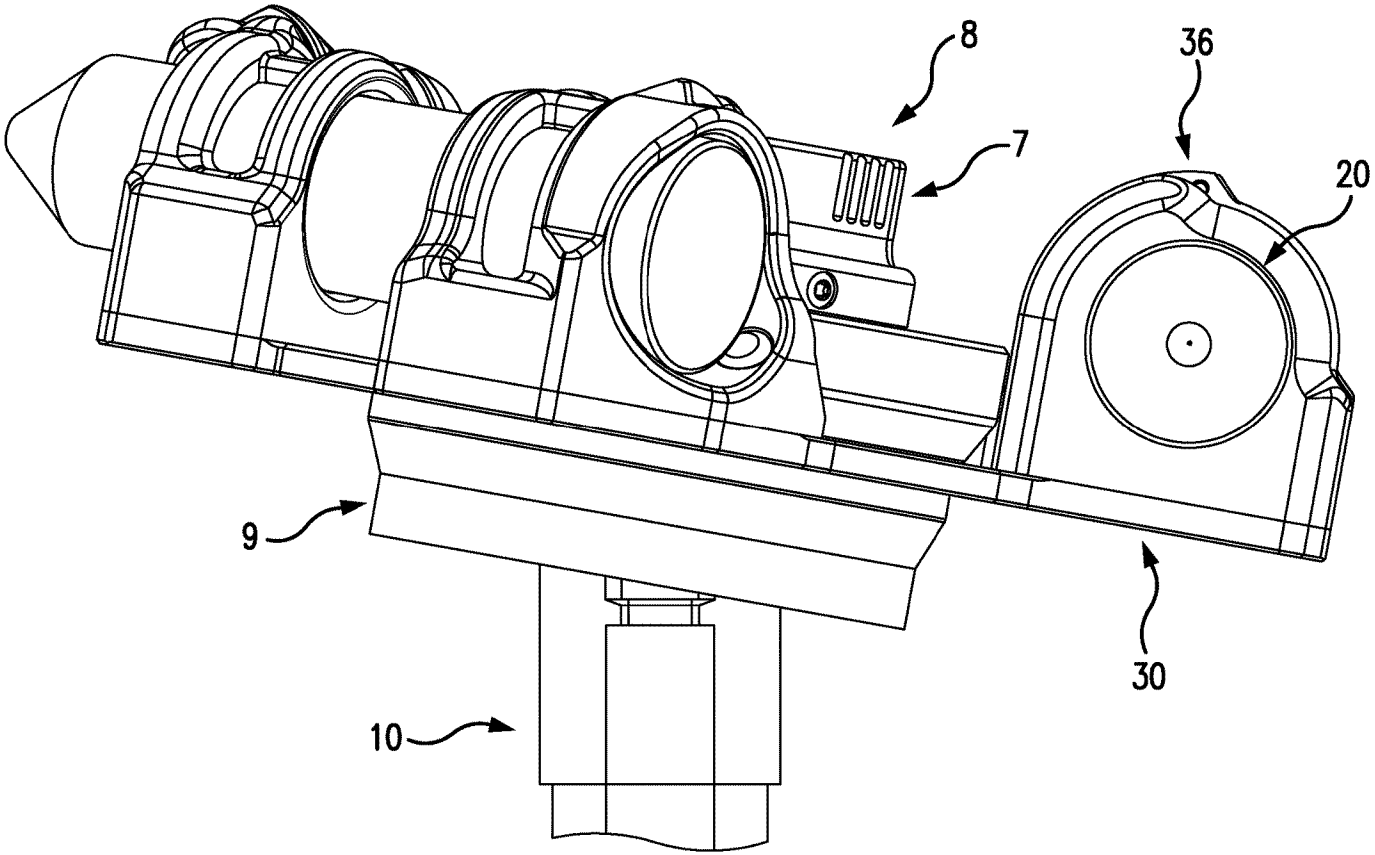
FIG. 11 is a side view of the processing plate and sample tubes of FIG. 1 shown in use with the position 2 tube (far right tube) in a position corresponding to FIGS. 6 and 10.
Figure 12:
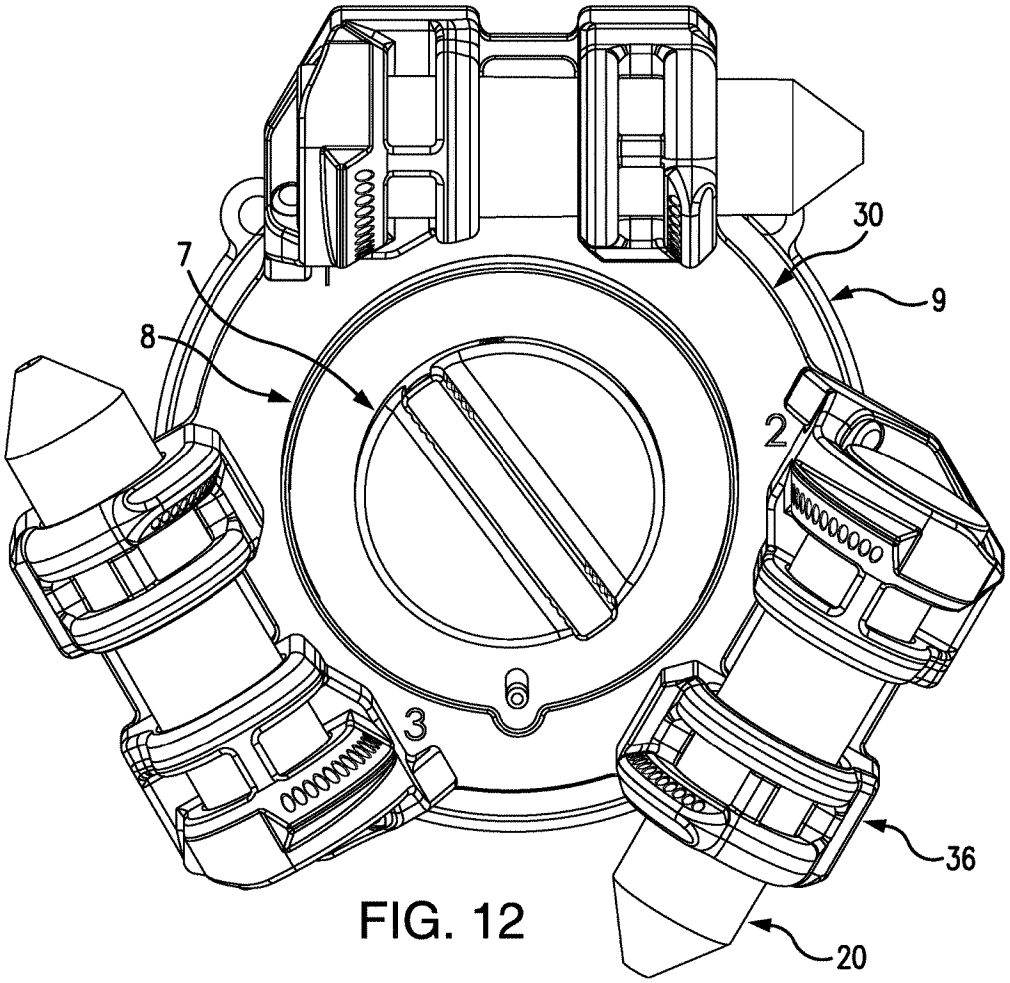
FIG. 12 is a plan view of the processing plate and sample tubes of FIG. 1 shown in use with the position 2 tube (bottom right tube) in a position corresponding to FIGS. 6 and 10.
Figure 13:
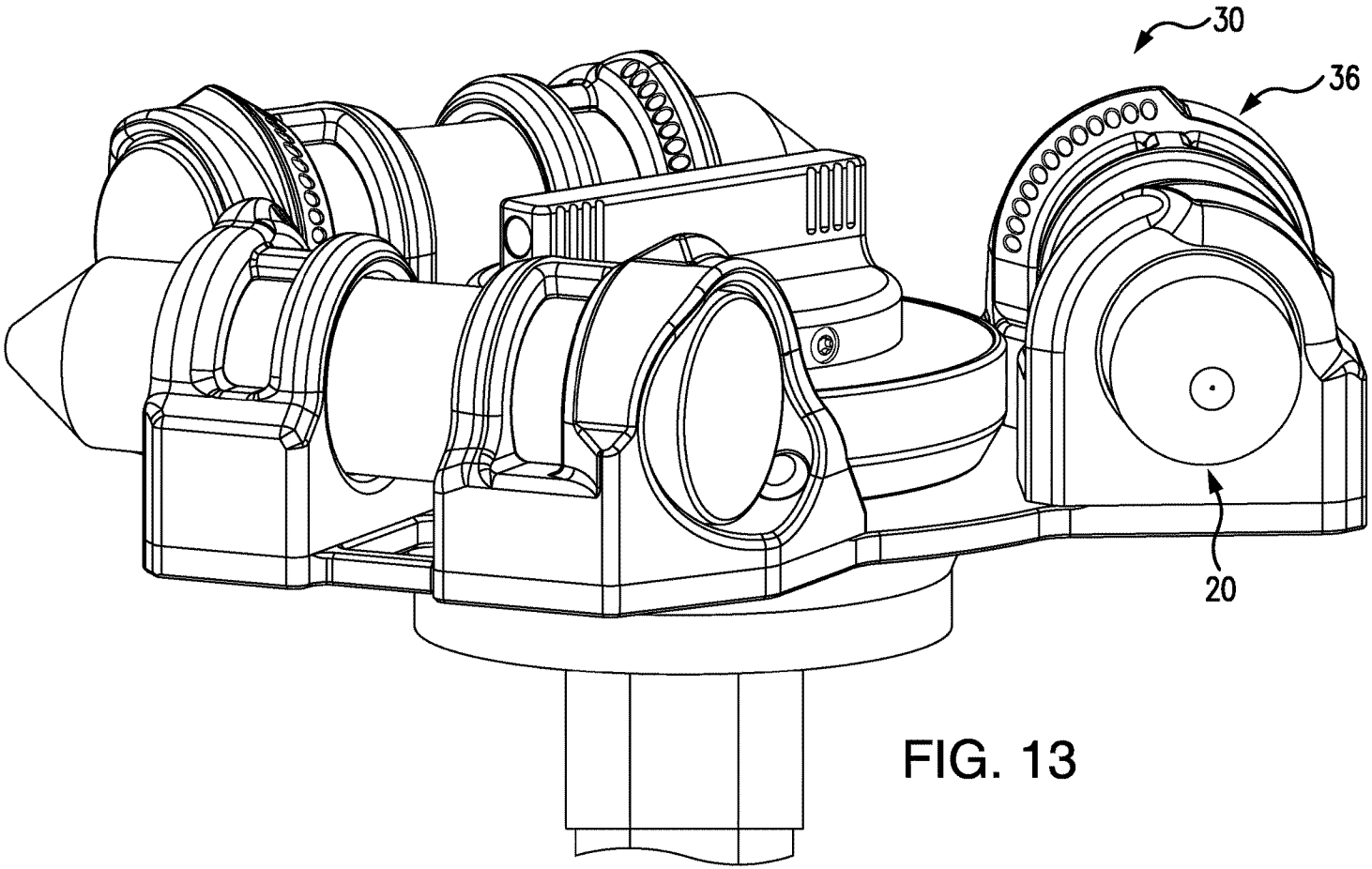
FIG. 13 shows the processing plate and sample tubes of FIG. 11 in use with the tube in a position corresponding to FIG. 7.
Figure 14:
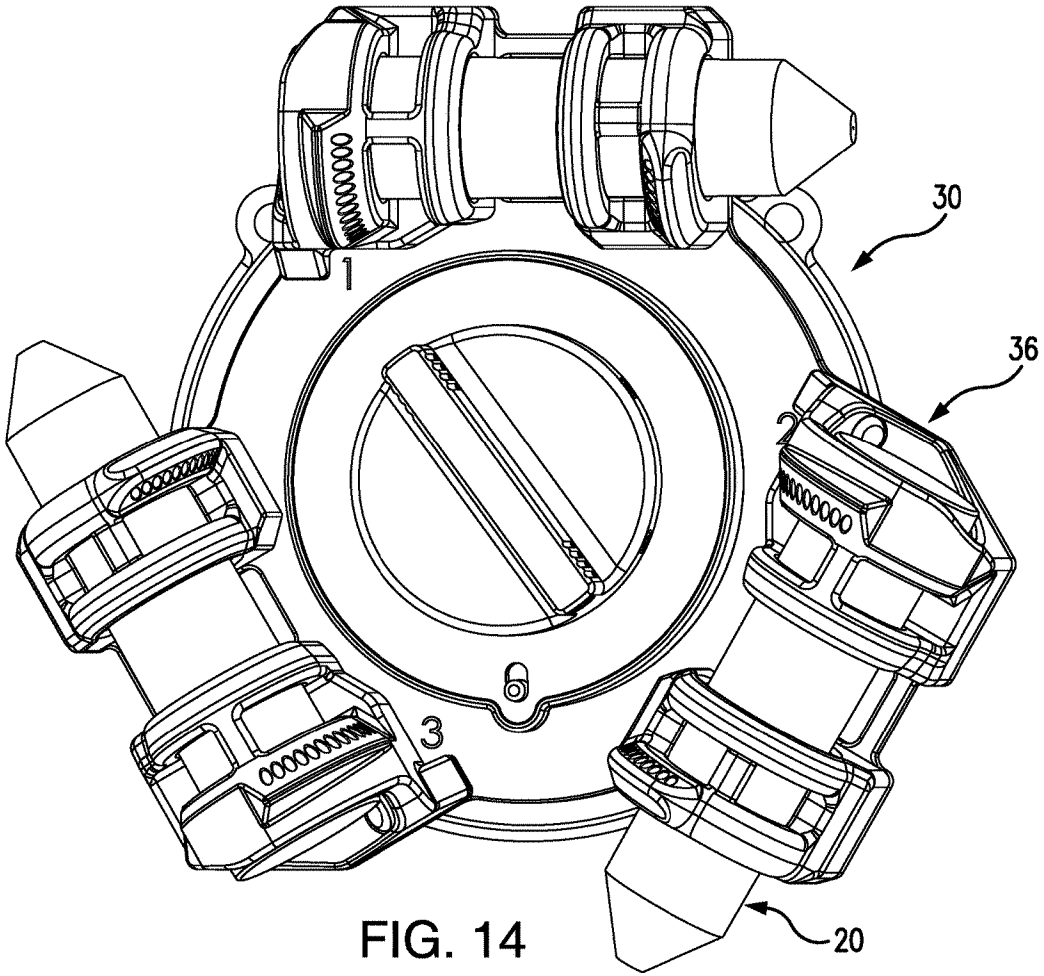
FIG. 14 shows the processing plate and sample tubes of FIG. 12 in use with the tube in a position corresponding to FIG. 7.
Figure 15:
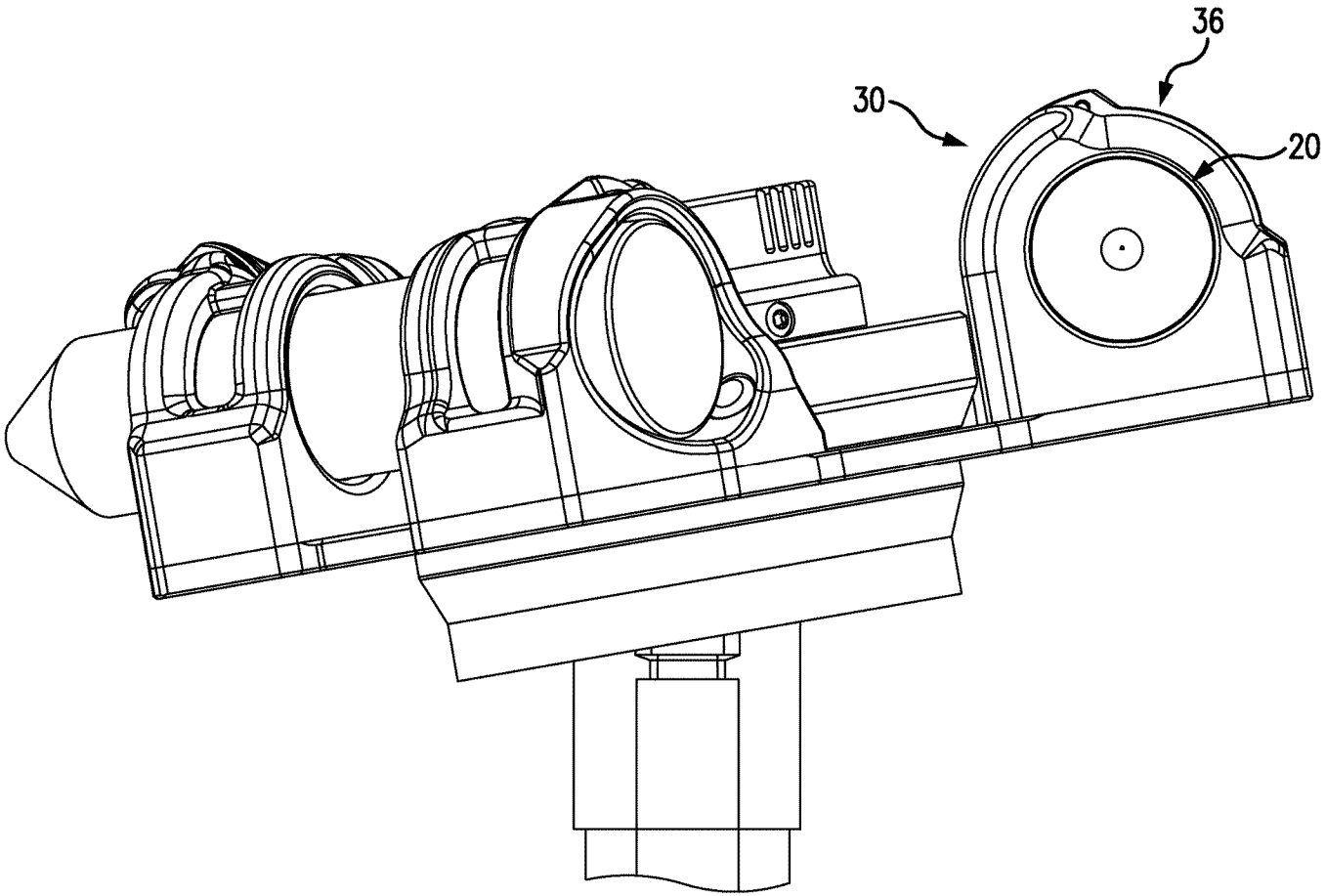
FIG. 15 shows the processing plate and sample tubes of FIG. 11 in use with the tube in a position corresponding to FIG. 8.
Figure 16:
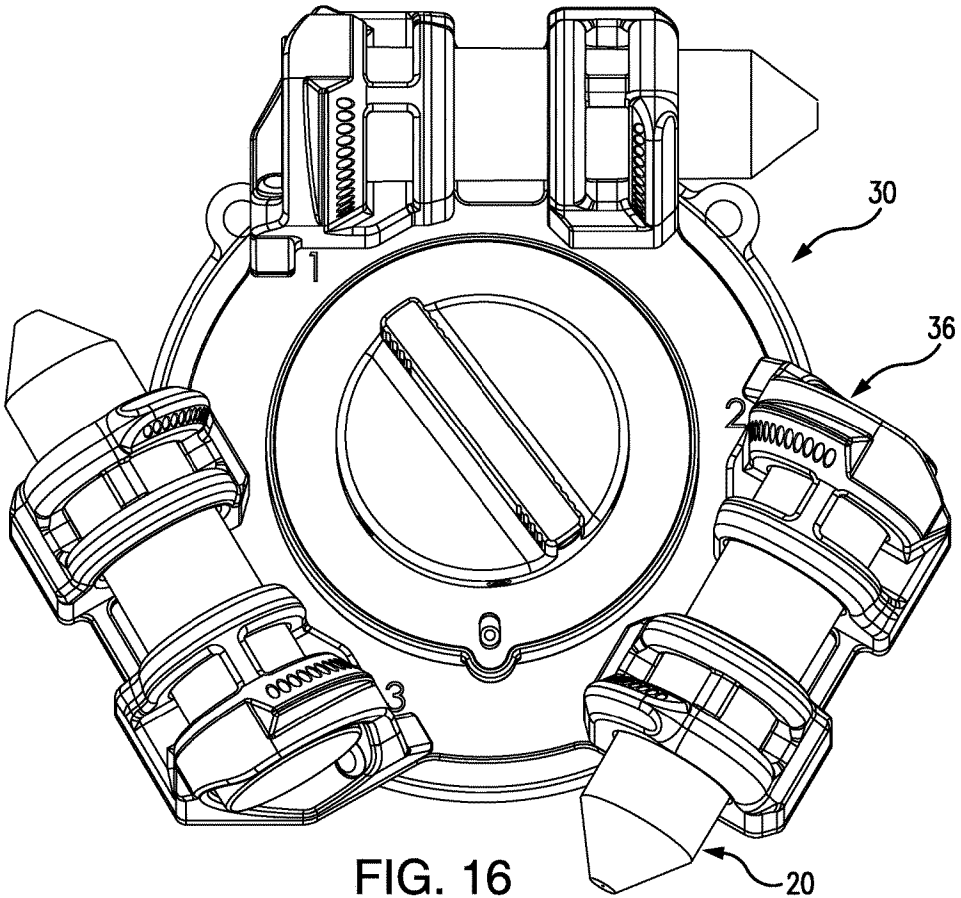
FIG. 16 shows the processing plate and sample tubes of FIG. 12 in use with the tube in a position corresponding to FIG. 8.
Figure 17:
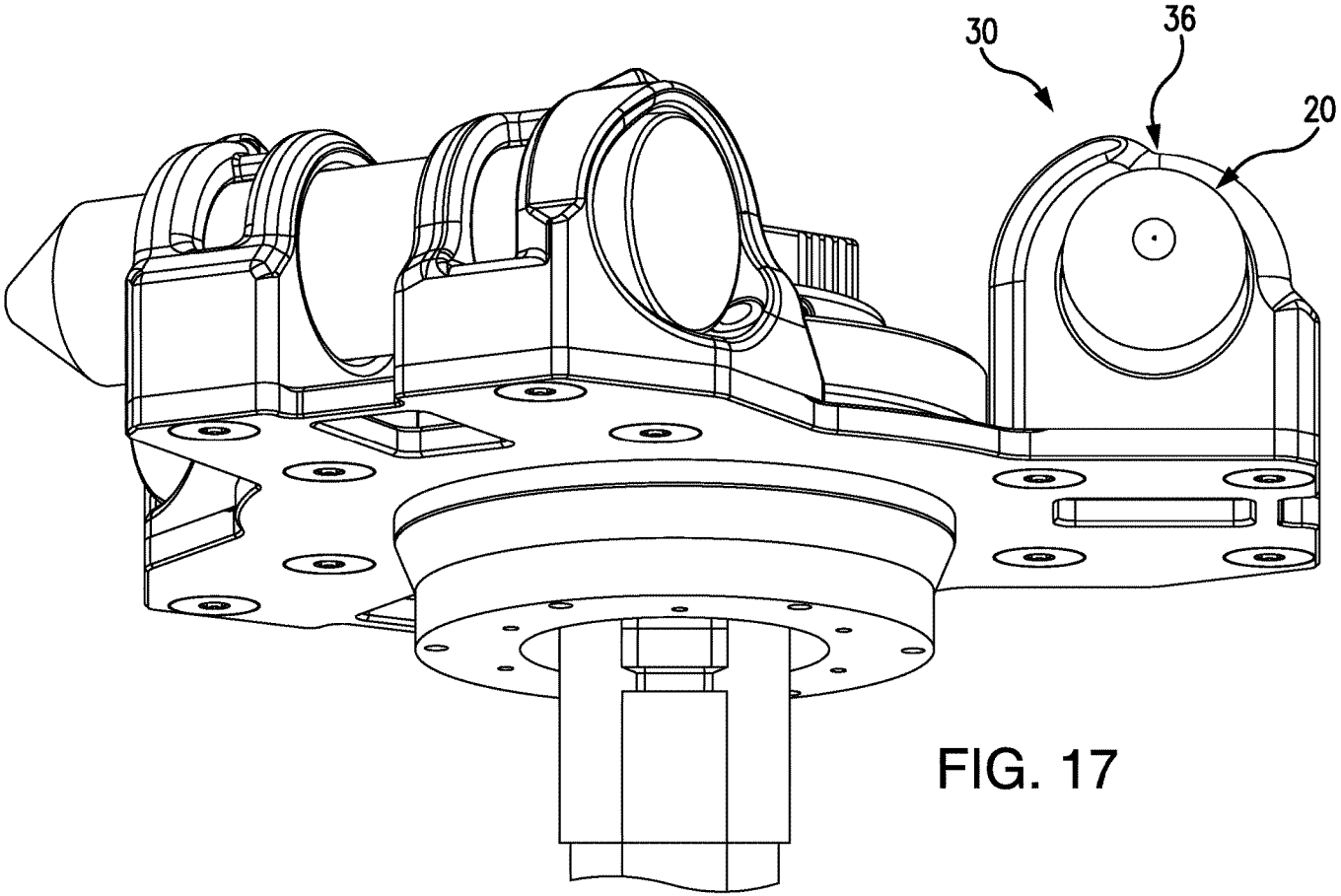
FIG. 17 shows the processing plate and sample tubes of FIG. 11 in use with the tube in a position corresponding to FIG. 9.
Figure 18:
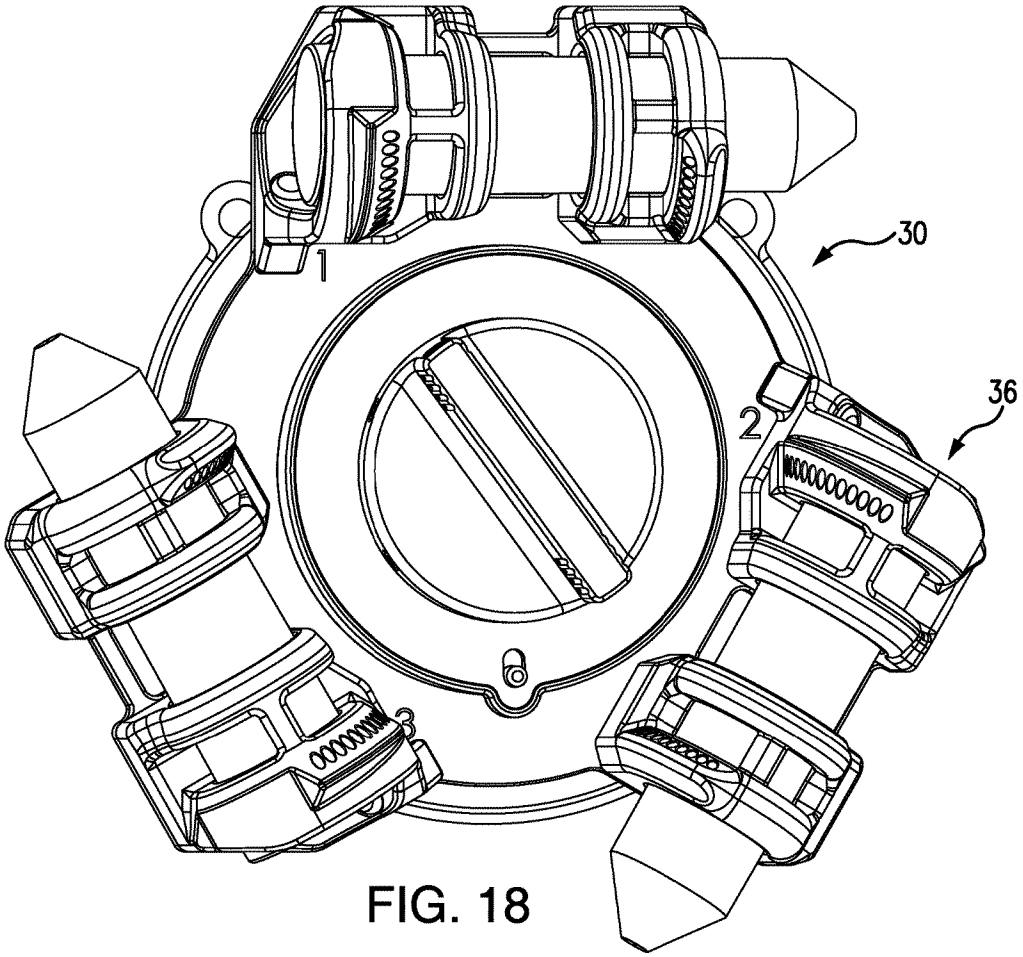
FIG. 18 shows the processing plate and sample tubes of FIG. 12 in use with the tube in a position corresponding to FIG. 9.

FIGS. 11-18 show side and plan views of the same 360-degree cycle of the sinusoidal swashing motion of the tubes 20 produced by the processing plate assembly 30, to help illustrate the swashing motion profile. In particular, FIGS. 11-12 show the tube 20 (of position 2, the far right tube) in a 0-degree/360-degree position corresponding to FIGS. 6 and 10. Similarly, FIGS. 13-14 show the tube 20 in the 90-degree position of FIG. 7, FIGS. 15-16 show the 180-degree position of FIG. 8, and FIGS. 17-18 show the 270-degree position of FIG. 9. As can be seen in FIGS. 11-18, particularly in combination with FIGS. 6-10, the bottom/forward end 15 of the tube 20 rotates downward, bottoms/levels out, rotates back upward, and then tops/levels out again, as the agitator 5 rotates around the hub 9 through sequential engagement with points/areas (defining a circular line or band) of the processing plate 30.

As described above, the centroids 14 of the tubes 20 are positioned offset forward of the perpendicular radius lines 40. In other embodiments, the centroids of the tubes are positioned offset on the opposite/top side (rearward relative to the depicted embodiment) of the perpendicular radius lines, the agitator rotational direction is opposite (rearward relative to the depicted embodiment), and the mechanical stops of the tube holders prevent opposite/topward (rearward relative to the depicted embodiment) axial movement of the tubes relative to their respective tube holders (in such "opposite" embodiments, the tube top/cap can be considered to define the forward direction/position).

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A processing plate assembly for mounting to a homogenizer and for holding at least one tube containing a sample to be homogenized, the processing plate assembly comprising:

a mounting structure that has a center axis and that mounts to the homogenizer about the center axis; and at least one tube holder attached to the mounting structure and holding the tube in a use position with the tube holder and the tube defining a longitudinal axis, with the longitudinal axis of the tube holder being generally parallel to the mounting structure, with a radius line of the mounting structure extending from the center axis of the mounting structure and intersecting the longitudinal axis of the tube, and with the tube holder holding the tube in the use position with a centroid of the tube positioned along the longitudinal axis of the tube holder and positioned offset from the radius line, wherein the tube holder includes at least one mechanical stop that contacts the tube in the tube holder in the use position to limit forward movement of the tube beyond the use position during homogenizing use, wherein the tube holder includes a rear-end opening through which the tube can be inserted forwardly into and removed rearwardly from the use position, and wherein in use the homogenizer operates the processing plate to impart sinusoidal swashing forces to the tubes that urge the tubes in the offset direction toward the mechanical stop into securement in the tube holder and that produce homogenization of the sample in the tube.

2. The processing plate of claim 1, wherein the mechanical stop is positioned forward of the rear-end opening of the tube holder and divides the tube holder into a larger-diameter tube-cap rear section and a smaller-diameter tube-container forward section.

3. The processing plate of claim 2, wherein the mechanical stop is provided by an inner flange of the tube holder.

4. The processing plate of claim 3, wherein the tube holder includes a bore that receives the tube and the inner flange is formed within the bore of the tube holder.

5. The processing plate of claim 1, wherein the tube holder includes at least one retainer that releasably contacts the tube to prevent rearward movement of the tube out of the tube holder under the force of gravity when not in homogenizing use.

6. The processing plate of claim 1, wherein the tube holder includes a front-end opening through which the tube extends in the use position to permit the use of different tube lengths with the same tube holder.

7. The processing plate of claim 1, wherein in the use position the tube centroid is offset forward of the radius line.

8. The processing plate of claim 1, wherein in the use position the longitudinal axis of the tube is perpendicular to the radius line so that the tube is tangentially positioned.

9. The processing plate of claim 1, wherein the tube holder holds the tube laying on a side of the tube and generally parallel to the mounting structure.

10. The processing plate of claim 1, wherein the mounting structure is provided by a flat plate with a center mounting opening that receives a hub of the homogenizer.

11. A processing plate assembly for mounting to a homogenizer and for holding at a plurality of tubes each containing a respective sample to be homogenized, the processing plate assembly comprising:

a mounting structure that has a center axis and that mounts to the homogenizer along the center axis; and a plurality of tube holders attached to the mounting structure and holding respective ones of the tubes in tangential use positions each with the tube and the tube holder defining a longitudinal axis, with a radius line of the mounting structure extending from the center axis of the mounting structure and perpendicularly intersecting the longitudinal axis of the tube, and with the tube holder holding the tube in the use position with a centroid of the tube positioned offset forward from the radius line, with the tube holder including at least one mechanical stop that contacts the tube in the tube holder in the use position to limit forward movement of the tube beyond the use position, and with the tube holder including a rear-end opening through which the tube is inserted forwardly into and removed rearwardly from the use position, wherein in use the homogenizer operates the processing plate to impart sinusoidal swashing forces to the tubes that urge the tubes in the offset forward direction into securement in the tube holder and that produce homogenization of the sample in the tube.

12. The processing plate of claim 11, wherein the mechanical stop is positioned forward of the rear-end opening of the tube holder and divides the tube holder into a larger-diameter tube-cap rear section and a smaller-diameter tube-container forward section.

13. The processing plate of claim 11, wherein the mechanical stop is provided by an inner flange of the tube holder, the tube holder includes a bore that receives the tube, and the inner flange is formed within the bore of the tube holder.

14. The processing plate of claim 11, wherein the tube holder includes at least one retainer that releasably contacts the tube to prevent rearward movement of the tube out of the tube holder under the force of gravity when not in homogenizing use.

15. The processing plate of claim 11, wherein the tube holder includes a front-end opening through which the tube extends in the use position to permit the use of different tube lengths with the same tube holder.

16. The processing plate of claim 11, wherein the mounting structure is provided by a flat plate with a center mounting opening that receives a hub of the homogenizer, and the tube holder holds the tube laying on a side of the tube and generally parallel to the flat-plate mounting structure.

17. The processing plate and the homogenizer of claim 11, in combination.

18. A processing plate assembly for mounting to a homogenizer and for use in homogenizing a sample, the processing plate assembly comprising:

a mounting structure that has a center axis and that mounts to the homogenizer about the center axis;

at least one tube containing the sample to be homogenized; and at least one tube holder attached to the mounting structure and holding the tube in a use position with the tube holder and the tube defining a longitudinal axis, with the longitudinal axis of the tube holder being generally parallel to the mounting structure, with a radius line of the mounting structure extending from the center axis of the mounting structure and intersecting the longitudinal axis of the tube, and with the tube holder holding the tube in the use position with a centroid of the tube positioned along the longitudinal axis of the tube holder and positioned offset from the radius line, wherein the tube holder includes at least one mechanical stop that contacts the tube in the tube holder in the use position to limit forward movement of the tube beyond the use position during homogenizing use, wherein the tube holder includes a rear-end opening through which the tube can be inserted forwardly into and removed rearwardly from the use position, and wherein in use the homogenizer operates the processing plate to impart sinusoidal swashing forces to the tubes that urge the tubes in the offset direction toward the mechanical stop into securement in the tube holder and that produce homogenization of the sample in the tube.

19. The processing plate of claim 18, wherein the mechanical stop is positioned forward of the rear-end opening of the tube holder and divides the tube holder into a larger-diameter tube-cap rear section and a smaller-diameter tube-container forward section, wherein the mechanical stop is provided by an inner flange of the tube holder, and wherein the tube holder includes a bore that receives the tube and the inner flange is formed within the bore of the tube holder.

20. The processing plate of claim 18, wherein in the use position the tube centroid is offset forward of the radius line.

* * * * *